US005520324A

United States Patent [19]

Cai

[11] Patent Number: 5,520,324

[45] Date of Patent: May 28, 1996

[54] CONTAINER FOR MULTIPLE FOODSTUFFS

[75] Inventor: Liming Cai, West Chester, Pa.

[73] Assignee: Dopaco, Inc., Downingtown, Pa.

[21] Appl. No.: 523,510

[22] Filed: Sep. 1, 1995

[51] Int. Cl.[6] ..... B65D 5/4805; B65D 5/20

[52] U.S. Cl. ..... 229/120.04; 229/114; 229/120.12; 229/148; 229/164; 229/906

[58] Field of Search ..... 229/114, 120.04, 229/120.08, 120.12, 148, 164, 902, 904, 906; 426/115, 119, 120

[56] References Cited

U.S. PATENT DOCUMENTS

| | | | |
|---|---|---|---|
| 2,843,307 | 7/1958 | Goltz | 229/164 |
| 3,352,053 | 11/1967 | Anderson | 229/120.08 |
| 3,542,280 | 11/1970 | Crabtree | 229/904 |
| 3,765,527 | 10/1973 | Vargo | 229/120.08 |
| 4,407,442 | 10/1983 | Watson et al. | 229/164 |
| 4,431,128 | 2/1984 | Dirico | 229/904 |
| 4,694,987 | 9/1987 | Forbes, Jr. | 229/120.04 |
| 4,763,832 | 8/1988 | Forbes, Jr. | 229/902 |
| 4,895,259 | 1/1990 | Paley | 229/164 |
| 5,039,003 | 8/1991 | Gordon et al. | 229/906 |
| 5,364,018 | 11/1994 | Carlsson | 229/906 |

*Primary Examiner*—Gary E. Elkins

*Attorney, Agent, or Firm*—Dennison, Meserole, Pollack & Scheiner

[57] ABSTRACT

A folded paperboard carton including first and second longitudinally aligned compartments with a common base panel, the first compartment including a cover integral therewith and foldable to overlie the first compartment, the second compartment extends above and opens upwardly relative to the closed first compartment with the inner wall of the cover dividing the two compartments.

16 Claims, 4 Drawing Sheets

CONTAINER FOR MULTIPLE FOODSTUFFS

BACKGROUND OF THE INVENTION

The invention is broadly concerned with disposable fast food containers, and particularly such containers formed from foldable blanks or sheets of shape-sustaining paperboard, thin cardboard, and the like.

The individual containers are normally adapted for particular foodstuffs. For example, a container for hamburgers is conventionally an approximately square upwardly opening tray which, in a "clam shell" version, includes an integrally formed closable lid or cover. The typical french fry container, for french fried potatoes, onion rings, and the like, is vertically elongate tapering from a narrow lower or base end to a wide upwardly directed mouth which facilitates both the introduction of the fries and the individual removal of the fries. Such fry containers are normally incapable of standing upright in a stable manner, and more frequently lie flat on the table or serving tray with the fries spilling therefrom.

One of the most commonly ordered fast food meals is "burger and fries". Such a combination is in fact usually encouraged by the offering of a special price slightly less than that were the items ordered separately. Heretofore, such an order has required the use of two separate containers, respectively specifically formed to accommodate the hamburger and the fries. This is turn requires the separate handling of two containers, both by the server and by the customer. The separate tall tapered fry container also requires special handling to accommodate the tendency of such containers to not stand upright in most circumstances.

The necessary use of two containers also requires that, during manufacture, separate equipment be provided to form the distinctly different containers or cartons from different basic blanks.

Other factors which enter into the consideration of the nature of disposable fast food containers include the amount of materials used and the problems in disposing of the used cartons in an environmentally correct manner. All of these factors must be considered in arriving at both a practical and user friendly carton, in conjunction with a carton which is economically feasible, that is adding minimal costs to the meal contained therein. As will be appreciated, any reduction in the cost of the carton itself can produce substantial savings when considering the thousands of meals served in such cartons at any typical fast food establishment.

SUMMARY OF THE INVENTION

The food carton or container of the present invention is of a construction which provides significant economic, user friendly and environmental advantages from the initial manufacture thereof through the final disposal.

More particularly, the carton is specifically configured to accommodate the typical combination fast food meal of a "burger and fries" in a single stable carton wherein the foodstuffs are received in separate although communicating compartments.

The carton is formed from a single compact blank, thus substantially reducing board usage as compared to the prior necessity of forming two separate cartons. This advantage is carried through all stages of the manufacturing process, including the die cutting of the board, and the remaining manufacturing steps including the folding, gluing and stacking of the containers.

Subsequently, the server need only handle a single carton in providing the "meal" of burgers and fries. The loaded carton can in turn be placed on the customer's tray without fear of spillage in that the fry compartment is stabilized and maintained upright through its integral association with the burger compartment.

The customer or consumer is also provided with a single easily carried carton wherein the individual foodstuffs are substantially segregated and the tendency for the fries to spill from a tipped container is eliminated. Rather, at the time of consumption, the fries will merely gradually flow into the burger compartment as the burger is removed. In this manner, the fries remain confined on the clean inner food surface of the carton, rather than spilling on the tray or tabletop.

Subsequent disposal of the single carton, as opposed to two cartons as heretofore required by a meal of burgers and fries inherently simplifies disposal considerations.

In achieving the advantages of the invention, the carton is formed with a tray portion having two separate although communicating compartments with a common elongate base or bottom panel. One compartment comprises a major portion of the length of the carton, and includes low outer end and side walls defining a tray-like receptacle with a lid or cover integrally hinged to the end wall and selectively foldable to overlie the side walls and base, generally in the manner of a clam-shell burger container.

The fry compartment, formed at the opposite end of the elongate base, includes an outer end wall and side walls all of a greater height than the first compartment walls, and forming a configuration generally similar to that of a partial conventional fry container opening upward above the closed lid of the burger compartment.

The fry compartment has no separate inner wall opposed from the outer wall. Rather, the inner face of the fry compartment is defined by the depending forward or inner wall on the lid which tapers generally in the manner of the fry compartment outer wall and tends to separately maintain the fries against free movement into the burger compartment until such time as the lid is raised and the burger removed.

The carton itself is easily carried by one hand, both when loading the foodstuffs and by the customer. In addition, the construction is such whereby the burger compartment lid, in addition to covering the burger compartment and defining the general parameters of the fry compartment, also, with or without positive interlock engages and stabilize the tall relatively narrow walls of the fry compartment. It is also contemplated that lift-assisting means be integrally formed with the lid to facilitate an opening of the lid.

Other features, objects and advantages of the invention will become apparent from the more detailed description following hereinafter.

DESCRIPTION OF PREFERRED EMBODIMENTS

Figure 1:
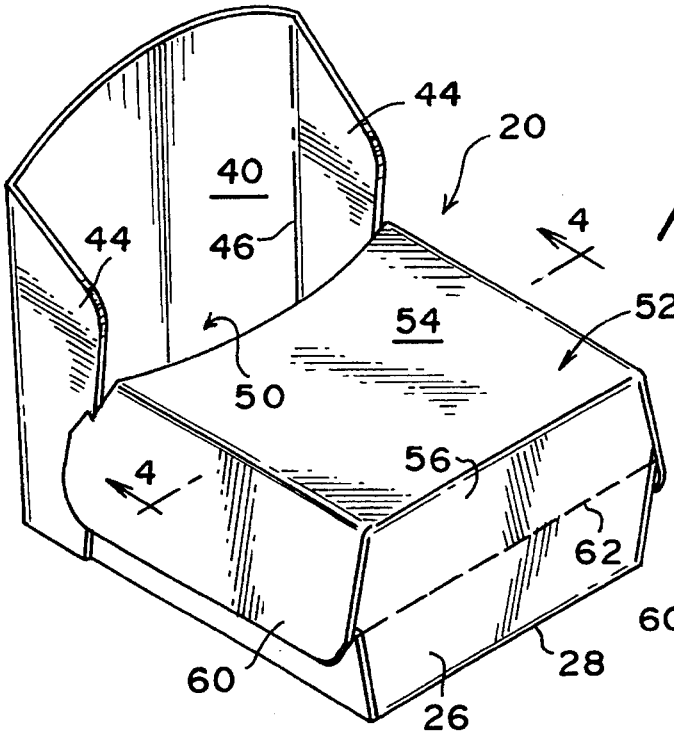
FIG. 1 is a top perspective view of the dual compartment carton of the invention.
Figure 2:
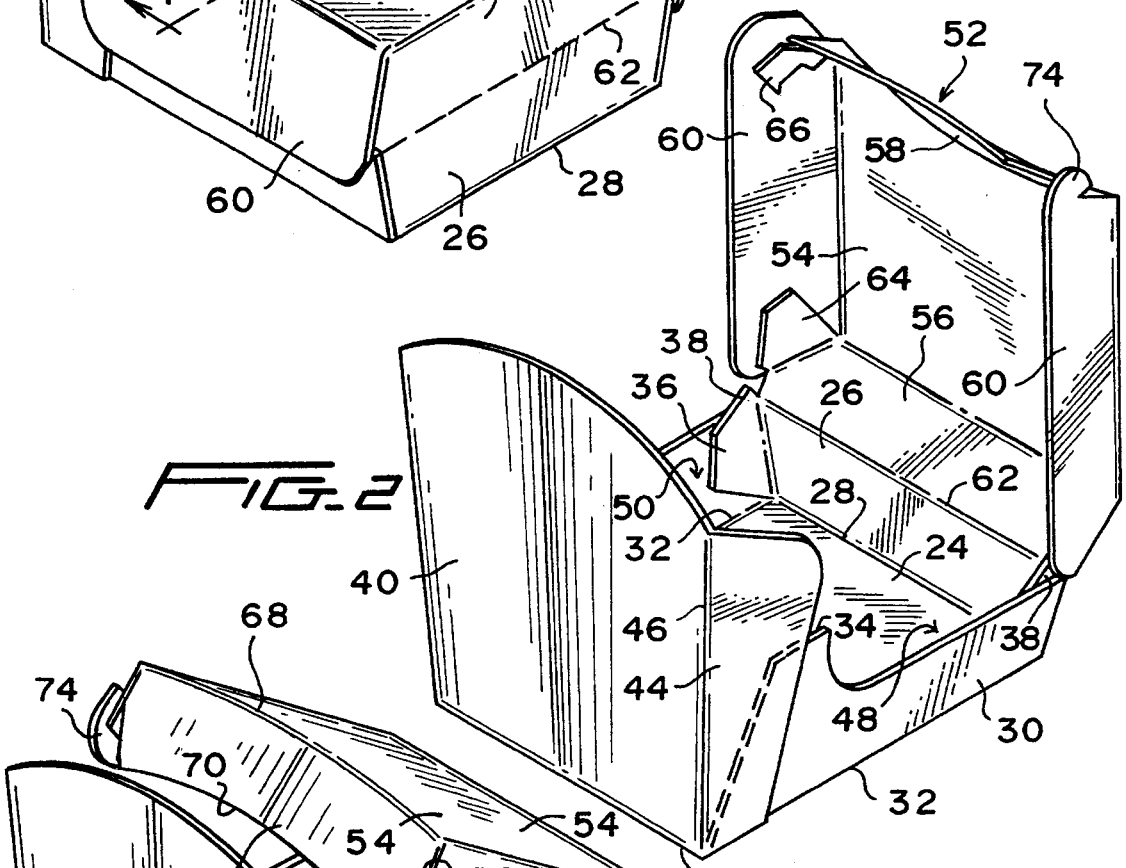
FIG. 2 is a perspective view with the lid opened generally 90 degrees to the burger compartment.

Turning first to FIGS. 1–4 and 11, the carton 20 is folded from a unitary blank 22 of appropriate paperboard material and retained in the carton configuration by adhesive bonding.

The carton 20 is of an elongate rectangular configuration with a base on bottom panel 24. A first outer end wall 26 is integral with one end of the base 24 along a fold line 28 and is coextensive with the corresponding end of the base.

A pair of side walls 30 are integral with the opposed side edges of the base 24 along the full length thereof with a fold line 32 defined between each side wall 30 and the adjacent base side edge.

Each of the side walls 30, for a major portion of the length thereof inward from the outer wall 26, is of substantial equal height with the outer wall 26. A minor portion of the length of each side wall 30, adjacent the remote end of each side wall 30, extends to a greater height than the end wall 26 to an upper edge which defines a support ledge or shoulder 34.

The walls 26 and 30 incline slightly outward upward from the base 24, with the outer wall 26 joined to the corresponding end portions of the side walls 30 by glue flaps 36 integrally folded from the opposed ends of the outer wall 26 and adhesively bonded to the inner faces of the side walls 30. As will be appreciated from FIG. 2, each glue flap 36 includes an upwardly extending portion or projection 38 which extends above the upper edge of the corresponding side wall 30.

The carton 20, remote from the outer end wall 26, includes a second outer end wall 40 coextensive with and folded from the opposite end of the base 24 along fold line 42. The end wall 40 is of a substantially greater height than the side walls 30 and extends above the adjacent shoulder-defining upper edges on the upwardly extending portions of the side walls 30. A pair of vertically elongate side walls 44 are integrally joined, along vertical fold lines 46, along the full height of the opposed vertical edges of the outer end wall 40 and extend inwardly along the opposed sides of the base 24 into overlapping relation to the adjoining end portions of the lower side walls 30. The side walls 44 are bonded to the side walls 30 and are of a width whereby the shoulders 34 on the side walls 30 extend inwardly relative to the slightly tapered inner edges of the side walls 44 at an elevation slightly greater than one half the height of the higher side walls 44. The relatively higher outer end wall 40 is slightly outwardly bowed along the height thereof and includes an arcuate upper edge. The adjacent higher side walls 44 generally follow the slight outward inclination of the lower side walls 30 to which they are adhesively bonded, thereby mutually rigidifying and stabilizing each other and retaining the end wall 40 in an upward, slightly outwardly inclined and slightly bowed position. The upper edges of the side walls 44 taper slightly downward and inward from the opposite ends of the arcuate upper edge of the end wall 40.

The tray portion of the carton thus far defined forms two compartments which, for purposes of identification, will be referred to as a "burger compartment" 48 and a "fry compartment" 50. The burger compartment is basically designed by the low end and side walls 26 and 30, while the fry compartment 50 is basically defined by the high end wall 40 and side walls 44. As will be appreciated from the drawings, each compartment of the unitary carton 20 broadly resembles the configuration of known separate burger and fry cartons.

The carton 20 is completed by the provision of an integral lid or cover 52 for the burger compartment 48. The lid 52 includes a substantially planar top panel 54 with opposed back and front walls 56 and 58, and opposed side walls 60 of equal length with and extending from the corresponding edges of the top panel 54. The walls 56–60 are integral with the top panel 54 with appropriate fold lines defined therebetween.

The lid back wall 56 is of generally equal depth or height as the tray outer wall 26, and coextensive with the upper edge thereof with an integral hinge line 62 therebetween.

The lid side walls 60 are of a slightly greater depth or height than the back wall 56 and flare slightly outward from the top panel 54 to, upon a closing of the lid 52 over the burger compartment 48, lie immediately outward of the lower tray side walls 30. The closing movement of the lid 52 is guided to a degree by the upwardly extending projections 38 on the glue flaps 36 securing the outer wall 26 to the tray side walls 30. As will be best seen in FIG. 2, appropriate glue flaps 64 and 66 are provided on the opposed ends of the lid back wall 56 and lid front wall 58 for adhesive bonding to the inner faces of the corresponding end portions of the opposed lid side walls 60.

The lid front wall 58 is of a forwardly directly concave configuration along the length thereof resulting from the concave nature of the fold line 68 joining the upper edge of the front wall 58 to the forward edge of the top panel 54. The front wall 58 also inclines forwardly as it extends outward from the top panel 54 providing in effect a cross-section configuration generally corresponding to that of the outer end wall 40 of the fry compartment 50, and a generally upwardly widening funnel-configuration to the fry compartment upon a full closing of the lid 52. Introduction of fries into the fry compartment 50 is facilitated by arcuately relieving the lower edge 70 of the lid front wall 58, the significance of this feature possibly being best appreciated from the cross-sectional view of FIG. 10.

The opposed ends of the lid front wall 58, to approximately mid-height, define downwardly directed notches 22 between the front wall edges and the adjoining outwardly flaring forward portions of the lid side walls 60. The upper portions of each of these front wall end edges are joined to the adjacent side walls 60 by the previously described glue flaps 66. The forward end portion of each of the lid side walls 60, in turn, terminates in a forwardly directed extension 74 projecting forward of the front wall 58 and including, aligned with the upper end of the adjacent notch 72, an upwardly directed V-shaped seat 76.

Figure 3:
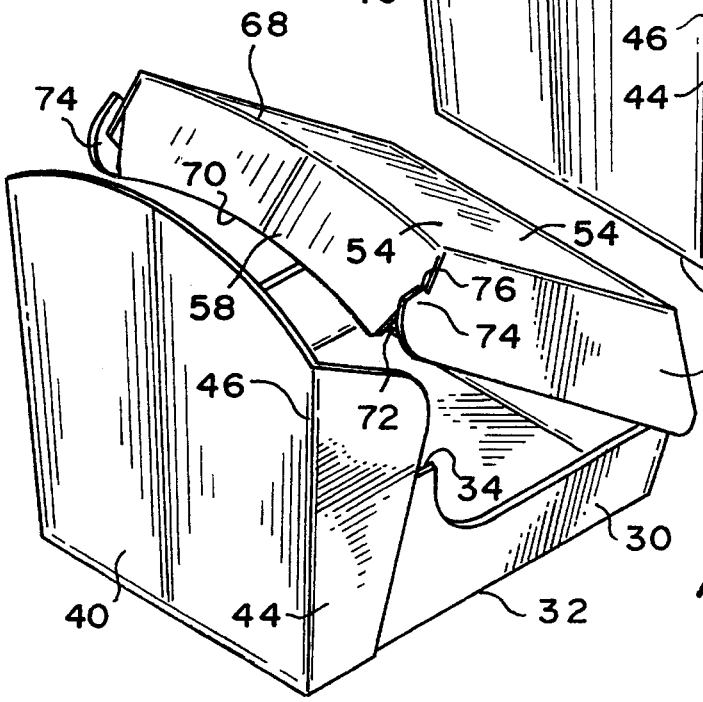
FIG. 3 is a perspective view with the lid moved toward the closed position.
Figure 4:
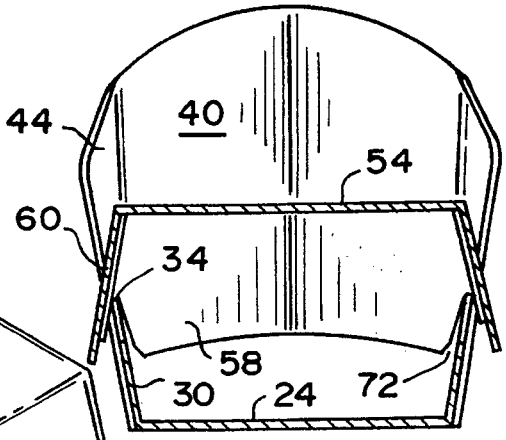
FIG. 4 is a transverse cross-sectional view taken substantially on a plane passing along line 4—4 in FIG. 1.

Noting FIGS. 3 and 4, upon a closing of the lid 52, the lid side walls 60 are received immediately outward of the tray side walls 30. The relatively higher forward portions of the side walls 30 are received within the recesses 72 at the opposite ends of the lid front wall 58 with the inner ends of the notches 72 seating on the abutment shoulders 34 immediately inward of the inner edges of the taller side walls 54 defining the fry compartment. The lid 52 is thus in a stabilized position and supported both adjacent the opposed corners of the front wall 58 thereof and along the rear wall 56.

With the lid closed, two distinct although integral and adjacent compartments are formed, one for a hamburger or like sandwich, and the other for an appropriate side order of french fried potatoes, onion rings, or the like. In actual use, the lid will be fully or almost fully open to allow for a placing of the burger within the burger compartment 48. The lid will then be closed to form the distinct fry compartment 50 within which the fries will be introduced. The inclined and arcuate configuration of the lid front wall 58 will tend to restrict the fries to the fry compartment, as will the presence of the burger within the burger compartment. When the meal is to be consumed, the lid can be fully opened and the burger removed, the fries naturally tending to gravitate into the burger compartment to allow for simplified access thereto. Further, inasmuch as the back wall 56 of the lid is of substantially equal height with the tray end wall 26 to which it is hingedly joined, the lid, when fully open, will actually define a separate upwardly opening compartment which can receive the partially eaten burger should it be desired to maintain a complete separation between the burger and fries. The two compartment carton, through the single enlarged base 24, is a stable unit from which the meal can be directly consumed without any danger of tipping or spillage, as for example with the conventional tapered fry carton.

The engagement of the lid side wall extensions 74 with the outer faces of the fry compartment side walls 44, in conjunction with the engagement of the shoulders 34 within the lid notches 72, provide for an effective frictional retention of the lid 52 in its closed position.

Figure 5:
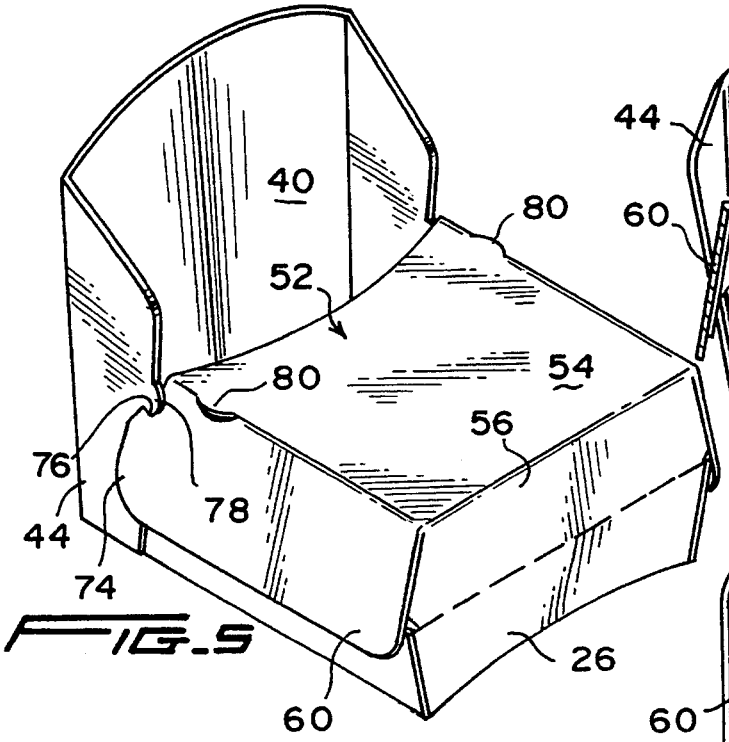
FIG. 5 is a top perspective view of a second embodiment incorporating locking lugs releasably fixing the position of the closed lid, and lifting tabs.
Figure 6:
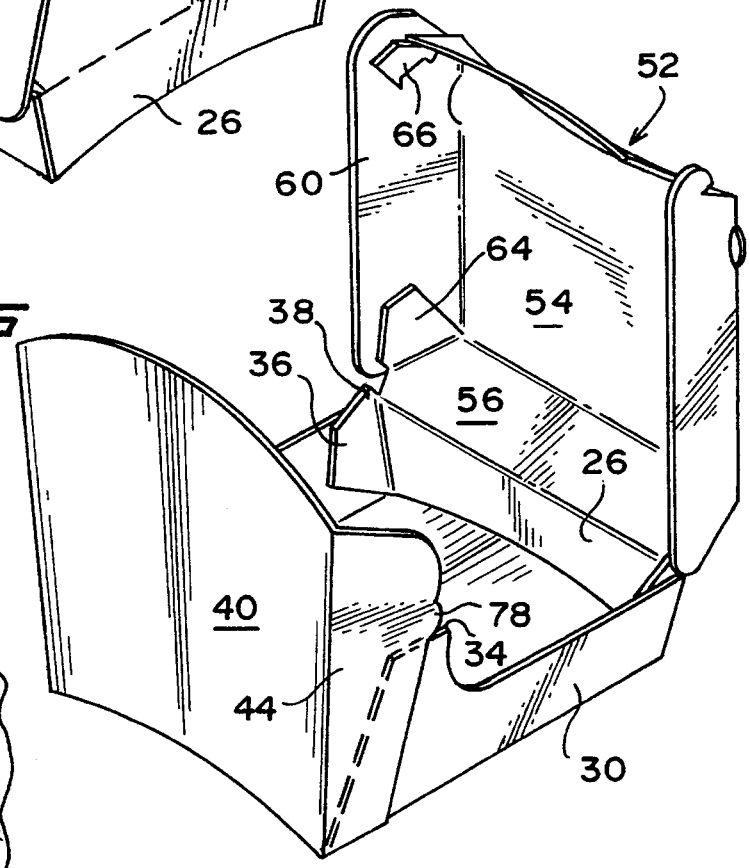
FIG. 6 is a perspective view of the carton of FIG. 5 with the lid open.
Figure 7:
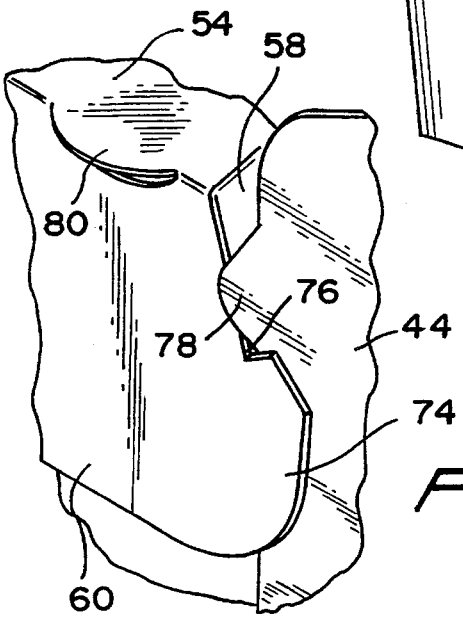
FIG. 7 is a perspective detail of the locking engagement of the lid.
Figure 12:
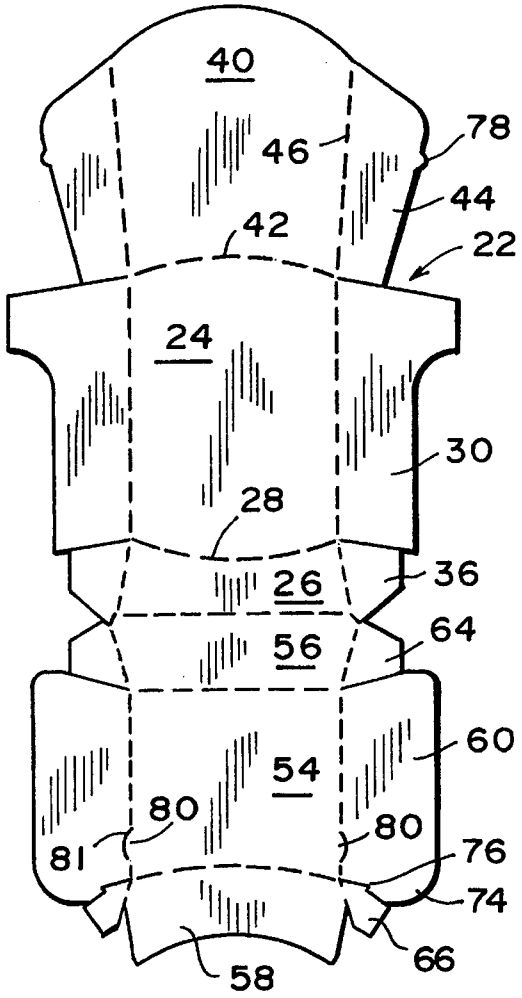
FIG. 12 is a plan view of the blank from which the carton of FIG. 5 is formed.
Figure 11:
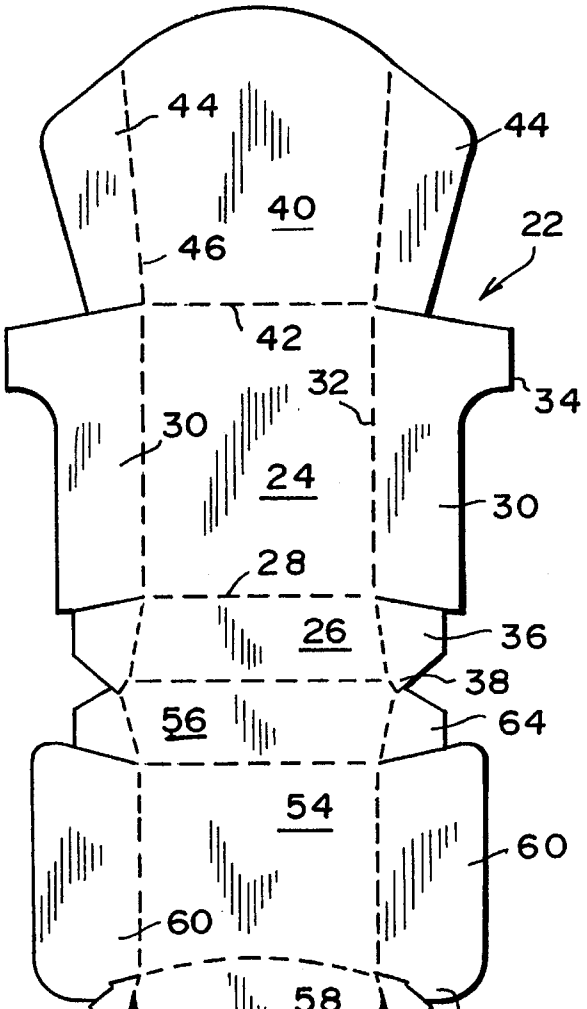
FIG. 11 is a plan view of the blank from which the carton of FIG. 1 is formed.

However, and noting FIGS. 5–7 wherein like numerals apply to like parts, a more positive lock for the lid 52 is also contemplated. More specifically, the forward edge of each of the fry compartment side walls 44, immediately above the corresponding shoulder 34, is provided with a rearwardly or inwardly directed integral rounded locking lug 78. These lugs 78, noting in particular the detail in FIG. 7 and due to the inherent resilient flexibility of the material of the carton, slide past the lid side wall extensions 74 and, upon a full seating of the lid 52, snap into releasable locking engagement within the upwardly directed locking seats 76 defined by the extensions 74. Release of the locking engagement, and hence the lid 52, will require a positive manual upward pivoting of the forward portion of the lid. In order to facilitate a grasping and opening movement of the lid, in the embodiment of FIGS. 5–7 the top panel 54 includes, along the opposite side edges thereof in close adjacent relation to the front edge, a pair of laterally extending opposed lifting tabs 80, each of which comprises a rigid coplanar extension of the top panel 54. As will be appreciated from the corresponding blank of FIG. 12, the side edge fold line does not extend across the corresponding tab 80. Rather, the tab 80 is, through an appropriate severance line 81, retained coplanar with the top panel 54 as the lid side wall 60 is folded relative thereto.

The width of the lid 52 is easily spanned by the hand of a consumer. As such, the thumb and fingers of a single hand can engage beneath the opposed tabs 80 for a simultaneous upward pull on the opposed sides of the lid for an opening of the hamburger compartment.

It will also be noted that the base or bottom panel 24 of the embodiment of FIGS. 5–7 is slightly upwardly concave along the length of the carton. This configuration, which aids in the stabilization of the carton and provides an insulating air space, is achieved by an arcuate forming of the end fold lines 28, 42 at the integral joinder of the end walls 26 and 40 to the base 24. The arcuate configuration of these fold lines 28 and 42 will be noted in the corresponding blank of FIG. 12.

Figure 8:
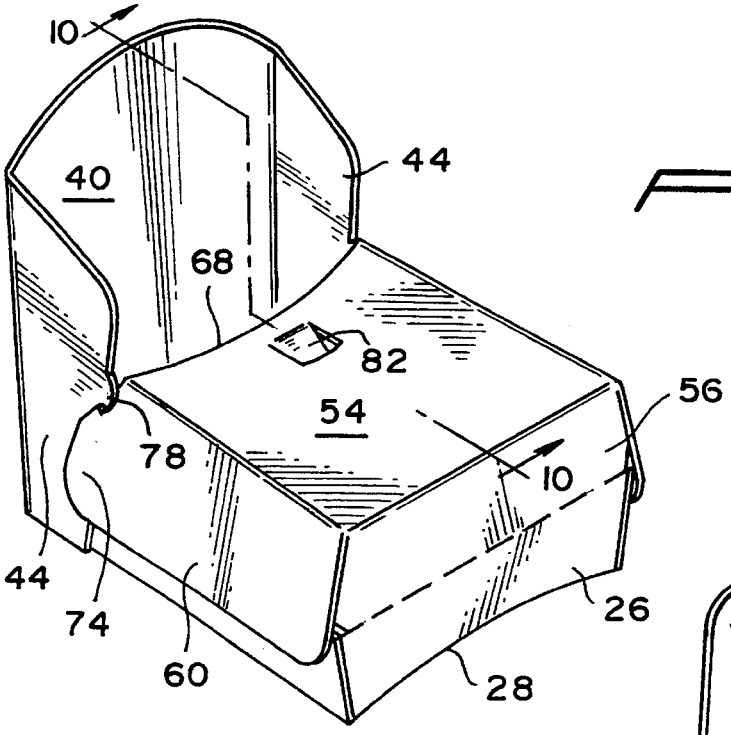
FIG. 8 is a top perspective view of a further embodiment incorporating locking lugs and lift means.
Figure 9:
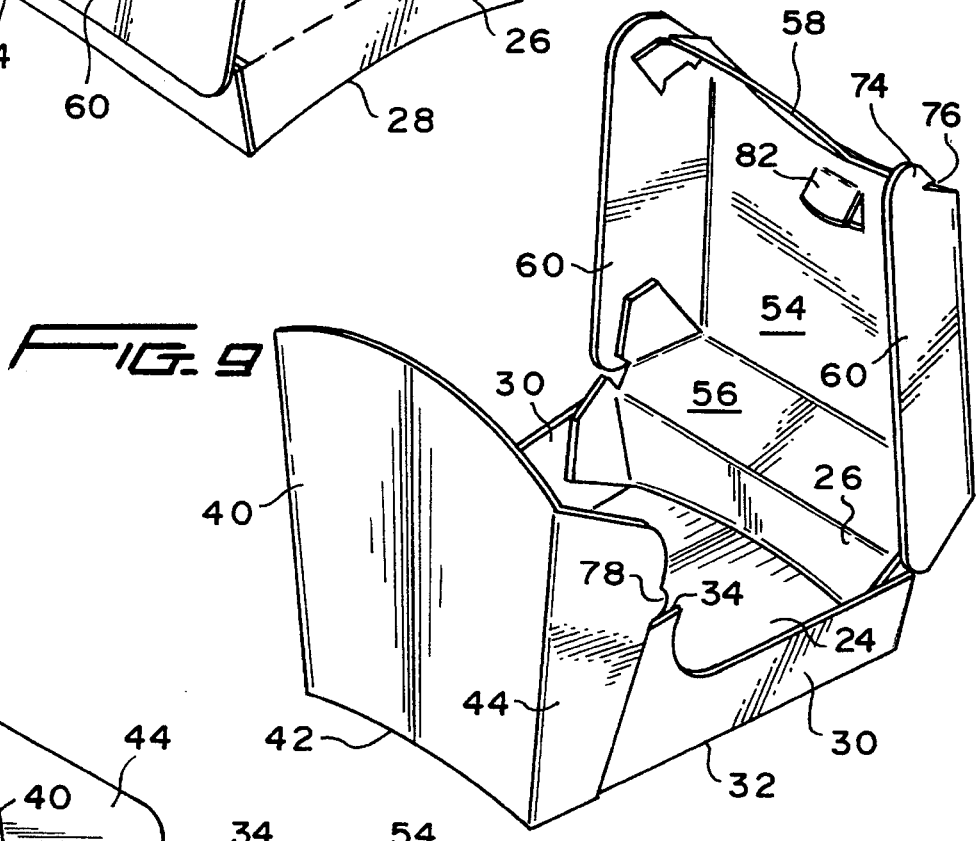
FIG. 9 is a perspective view of the carton of FIG. 8 with the lid open.
Figure 10:
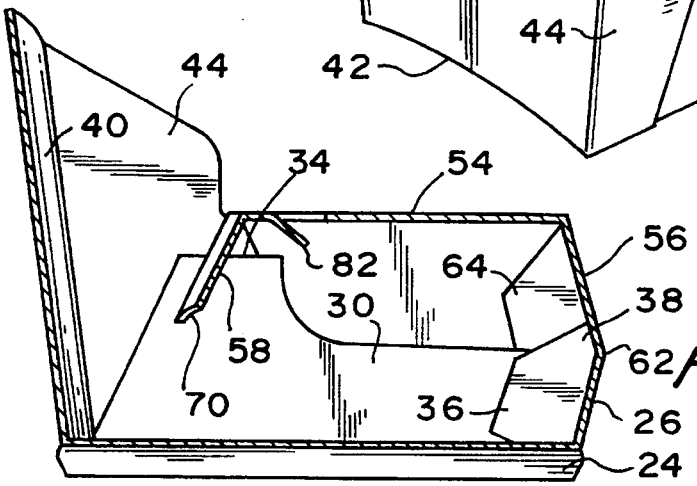
FIG. 10 is a longitudinal cross-sectional view taken substantially on a plane passing along line 10—10 in FIG. 8.
Figure 13:
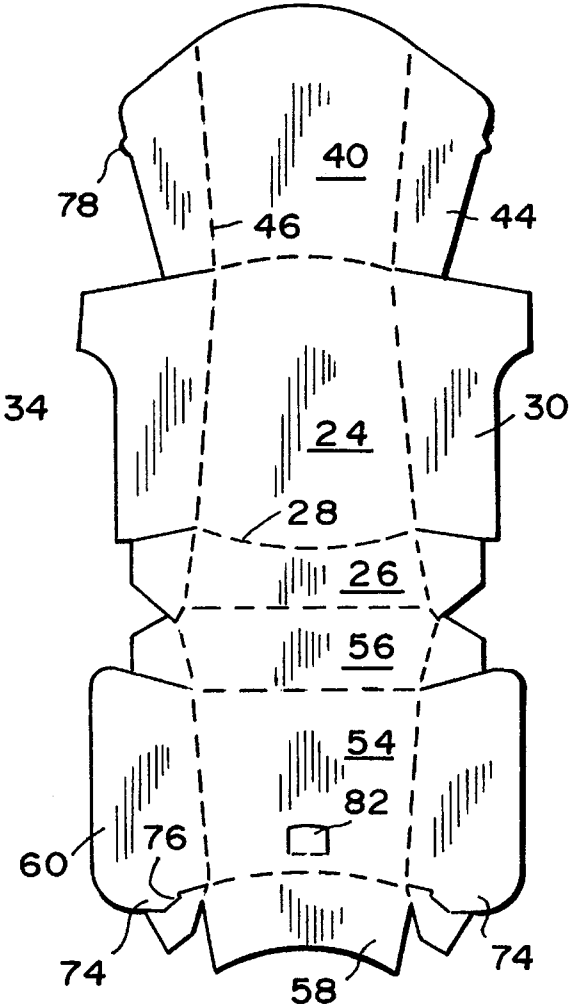
FIG. 13 is a plan view of the blank from which the carton of FIG. 8 is formed.

FIGS. 8–10, along with the blank of FIG. 13 and wherein like numerals refer to like parts, illustrate a further embodiment incorporating the locking lugs 78 and the arcing base or bottom panel. This embodiment differs from the previous embodiment in providing a lifting flap 82 in the top panel 54 in closely spaced adjacent relation to the front wall 58 and generally on the longitudinal center line of the panel. This flap 82 is severed from the panel along three edges thereof and integral with the panel along its forward edge. The flap 82 can extend upwardly from the top panel 54 for easy grasping between the fingers to raise the lid. Alternatively, and as illustrated, the flap can be folded inward relative to the top panel, providing in effect a finger hole to grasp and raise the lid. With either arrangement, the hole defined by the flap 82 will provide a desirable venting of the burger compartment to avoid an overly moist or soggy product.

Additional venting will be provided by the outwardly flaring lid side walls 60 which are spaced outwardly from the upper edges of the tray side walls 30 for a major portion of the length of the burger compartment as the forward portion of the lid is supported on the support shoulders 34. The relative relationship between the upper and lower side walls will be best appreciated from the cross-sectional details of FIGS. 4 and 10.

It is to be appreciated that the tapered walls of the tray and lid of the carton, in addition to being desirable for facilitating the insertion and removal of the foods, particularly in the fry compartment, and for facilitating of the opening and closing of the lid, also perform a significant function in allowing for a stacking of the open cartons prior to use. This simplifies both shipping and storage. It will also be recognized that there is a substantial savings in paperboard material and construction steps as compared to the prior necessity of using two cartons. For example, one wall of the fry container is no longer required in that the adjacent lid wall of the burger compartment fulfills this function. It will also be appreciated that the gluing and folding procedures are substantially no more complex than that required for a single burger container, notwithstanding the dual compartment nature of the carton of the invention. Similarly, the number of glue points and the actual folding steps involved are approximately only what would be required for a burger carton.

What is claimed is:

1. A combined carton for foodstuffs including a tray section comprising a base with first and second opposed end edges and opposed side edges, first and second longitudinally aligned adjacent compartments extending respectively inward from said opposed end edges of said base, said first compartment having a first outer end wall extending upward from said base first end edge and opposed first compartment side walls extending upward from said opposed base side edges adjacent to and extending inward relative to said first outer end wall, said second compartment having a second outer end wall extending upward from said second end edge and opposed second compartment side walls extending upward from said base side edges adjacent to and extending inward relative to said second compartment outer end wall, said first and second side walls forming continuous tray side walls, said second compartment end wall and side walls being of a greater height than said first compartment end wall and side walls, and a cover for and coextensive with said first compartment, said cover being selectively moveable to a closed position on said first compartment side walls in overlying relation to said first compartment, said second compartment opening upwardly above said first compartment.

2. The carton of claim 1 wherein said cover includes a back wall longitudinally coextensive with said first outer end wall, and a front wall spaced from and generally parallel to said cover back wall, said cover front wall being, in a closed position of said cover overlying said first compartment, inwardly spaced from said second outer end wall and defining said second compartment therebetween.

3. The carton of claim 2 wherein said cover back wall is integral with said first outer end wall with a hinge defined therebetween for a selective opening and closing of said cover relative to said first compartment, said cover including a pair of opposed side walls extending between said back and front walls of said cover.

4. The carton of claim 3 wherein said cover front wall includes opposed end edges, said cover side walls including forward portions overlying said front wall end edges, said front wall end edges each being partially spaced from the corresponding side wall forward portion and defining, in the closed position of the cover, a downwardly directed notch, said side walls of said tray section including a pair of transversely aligned upwardly directed cover support shoulders received within said notches and defining the closed position of said cover.

5. The carton of claim 4 wherein each cover side wall includes a forward projection extending beyond said cover front wall and, in the closed position of said cover, in partially overlying relation to said second compartment side walls, each said second compartment side wall having an inwardly directed edge, and a latching lug extending from said inwardly directed edge in vertically spaced relation above each of said support shoulders, each said lug, in the closed position of said cover, engaging over and downwardly latching the corresponding cover side wall projection.

6. The carton of claim 5 wherein each cover side wall projection includes an upwardly directed recess therein aligning with and receiving the corresponding latching lug.

7. The carton of claim 5 wherein said cover includes a top panel with opposed back and front edges, and opposed side edges from which the cover walls extend, said top panel having finger-accommodating lift means thereon for hand manipulation of said cover.

8. The carton of claim 7 wherein said second compartment outer end wall and said cover front wall, when said cover is closed, converge downwardly toward each other, said cover front wall terminating above said base.

9. The carton of claim 8 wherein said cover back wall is of substantially the same height as said first compartment outer end wall wherein said cover, in the open position thereof, can be positioned adjacent and substantially coplanar with said first compartment.

10. The carton of claim 8 wherein said base is transversely arcuate between the opposed side edges thereof.

11. The carton of claim 10 wherein said opposed first compartment side walls, adjacent said first outer end wall, each include an upwardly directed projection for guiding said cover to said closed position.

12. The carton of claim 3 wherein said carton is formed from a unitary blank of foldable shape-sustaining material, said blank including integral glue flaps.

13. The carton of claim 7 wherein said lift means comprises a pair of tabs defining extensions from said top panel and extending beyond said opposed cover side walls.

14. The carton of claim 7 wherein said lift means includes a pivotal flap within said top panel adjacent said cover front wall, and an aperture defined by said flap.

15. A unitary blank of foldable shape-sustaining material comprising an elongate bottom panel with first and second opposed outer end edges and opposed side edges, first and second outer end walls coextensive respectively with said first and second outer end edges with fold lines defined along said end edges, said second end wall terminating in a free outer edge and having opposed side edges with coextensive side walls extending therefrom and with fold lines defined therebetween, said first end wall being of a substantially lesser width outward from said corresponding bottom panel end edge than said second end wall, a cover back wall of substantially equal width with said first end wall immediately outward thereof and with a hinge-defining fold line therebetween, a cover top panel integral with and outward of said cover back wall with a fold line therebetween, said top panel being of a length, outward from said cover back wall less than the length of said bottom panel outward from said first end wall whereby said top panel, upon closure over said bottom panel will extend only partially toward said second end wall, said cover having a front wall integral with the top panel and opposed from said back wall, said front wall terminating in a free outer edge remote from said top panel, said second end wall having a width outward from said top panel greater than the combined width of said first end wall and said cover back wall.

16. A dual compartment carton formed from a unitary blank of a paperboard-like material, said carton including a tray section with first and second compartments defined therein, an elongate base panel common to both compartments, first and second end walls extending from said base panel and defining the longitudinal extent of said tray section, side walls extending between said first and second end walls, a cover integral with said first end wall and foldable relative thereto to selectively move between an open position remote from said tray section and a closed position overlying said tray section, said cover, in said closed position, overlying only a portion of said base panel and terminating in spaced relation to said second end wall, said cover including an inner edge wall dividing said tray into said first compartment underlying said cover and said second compartment extending from said cover to said second and wall, said second end wall being of a substantially greater height than the covered first compartment and opening upwardly thereabove for the introduction and removal of ingredients without opening said cover.

* * * * *